US007975770B2

(12) United States Patent
Keener

(10) Patent No.: US 7,975,770 B2
(45) Date of Patent: Jul. 12, 2011

(54) DUAL-BOP AND COMMON RISER SYSTEM

(75) Inventor: Chip Keener, Montgomery, TX (US)

(73) Assignee: Transocean Offshore Deepwater Drilling Inc., Houston, TX (US)

( * ) Notice: Subject to any disclaimer, the term of this patent is extended or adjusted under 35 U.S.C. 154(b) by 0 days.

(21) Appl. No.: 11/615,811

(22) Filed: Dec. 22, 2006

(65) Prior Publication Data

US 2007/0163782 A1 Jul. 19, 2007

Related U.S. Application Data

(60) Provisional application No. 60/753,054, filed on Dec. 22, 2005.

(51) Int. Cl.
*E21B 7/12* (2006.01)

(52) U.S. Cl. ..... 166/358; 166/339; 166/340; 166/367; 166/368; 175/5; 175/7

(58) Field of Classification Search ..... 166/358, 166/338–340, 366–368; 175/5–10
See application file for complete search history.

(56) References Cited

U.S. PATENT DOCUMENTS

| | | | | |
|---|---|---|---|---|
| 2,503,516 | A | 4/1950 | Shrewsbury | |
| 3,380,520 | A | 4/1968 | Pease | |
| 3,682,243 | A * | 8/1972 | Bauer et al. | 166/338 |
| 3,981,369 | A * | 9/1976 | Bokenkamp | 175/5 |
| 4,147,221 | A | 4/1979 | Ilfrey et al. | |
| 4,351,261 | A | 9/1982 | Shanks | |
| 4,378,848 | A * | 4/1983 | Milberger | 166/351 |
| 4,624,318 | A * | 11/1986 | Aagaard | 166/359 |
| 4,681,173 | A | 7/1987 | Disher et al. | |
| 4,819,730 | A | 4/1989 | Williford et al. | |
| 4,850,439 | A * | 7/1989 | Lund | 175/52 |
| 5,676,209 | A * | 10/1997 | Reynolds | 166/345 |
| 6,047,781 | A * | 4/2000 | Scott et al. | 175/5 |
| 6,056,071 | A * | 5/2000 | Scott et al. | 175/5 |
| 6,068,069 | A * | 5/2000 | Scott et al. | 175/5 |
| 6,085,851 | A * | 7/2000 | Scott et al. | 175/7 |
| 6,217,258 | B1 * | 4/2001 | Yamamoto et al. | 405/201 |
| 6,227,300 | B1 * | 5/2001 | Cunningham et al. | 166/339 |
| 6,408,947 | B1 * | 6/2002 | Cunningham et al. | 166/339 |
| 6,453,838 | B1 * | 9/2002 | Mowell et al. | 114/230.13 |
| 6,715,554 | B1 * | 4/2004 | Cunningham et al. | 166/348 |

(Continued)

FOREIGN PATENT DOCUMENTS

GB 2041836 9/1980

(Continued)

OTHER PUBLICATIONS

International Search Report issued Apr. 14, 2008 during the prosecution of International Application No. PCT/US06/62574.

(Continued)

*Primary Examiner* — Thomas A Beach
*Assistant Examiner* — Matthew R Buck
(74) *Attorney, Agent, or Firm* — Fulbright & Jaworski, LLP

(57) ABSTRACT

The disclosure is drawn to methods of drilling wells utilizing blow out prevention components of differing pressure ratings. In the initial drilling phase, a lower pressure rated blow out prevention component is used. In a subsequent drilling phase where a reservoir of a natural resource is penetrated, a higher pressure rated blow out prevention component is used.

20 Claims, 1 Drawing Sheet

U.S. PATENT DOCUMENTS

| | | | | |
|---|---|---|---|---|
| 6,968,902 | B2 * | 11/2005 | Fenton et al. | 166/358 |
| 7,021,402 | B2 * | 4/2006 | Beato et al. | 175/7 |
| 7,063,157 | B2 * | 6/2006 | Bartlett | 166/339 |
| 7,073,593 | B2 * | 7/2006 | Hatton et al. | 166/367 |
| 7,086,474 | B1 * | 8/2006 | Trevithick et al. | 166/379 |
| 7,134,498 | B2 * | 11/2006 | Hopper | 166/357 |
| 7,143,830 | B2 * | 12/2006 | Bartlett | 166/339 |
| 2005/0217845 | A1 * | 10/2005 | McGuire | 166/100 |
| 2005/0249558 | A1 * | 11/2005 | Humphreys | 405/224.2 |

FOREIGN PATENT DOCUMENTS

| | | |
|---|---|---|
| GB | 2071734 | 9/1981 |
| GB | 2182083 | 5/1987 |
| GB | 2291664 | 1/1996 |

OTHER PUBLICATIONS

Written Opinion of the International Searching Authority issued Apr. 14, 2008 during the prosecution of International Application No. PCT/US06/62574.

Arendal Göthverken AB, "GVA Twindriller: Semi-Submersible Drilling Unit." Technical Description Document. Feb. 20, 1986. 23 pages.

Baguin, "The Role of Semi-Submersible Crane Vessels in Deepwater Field Developments: Overview of Previous Experience and New Applications," Paper presented during the 10th Offshore South East Asia Conference and Exhibition, held at the World Trade Center in Singapore, and cited Dec. 6-9, 1994. 12 pages.

Day et al., "Addressing and Meeting the Deepwater Design Challenge," Deepwater Offshore Technology Conference, Rio De Janeiro, Oct. 2001. 18 Pages.

Maritime Hydraulics, "Preliminary Proposal From Smedvig Dual Operation Drilling," Sales & Admin Dept document. Mar. 19, 1996. 13 Pages.

Maritime Engineering A.S., "ME 5500: Dual Rig System" Design and Development document. Dated Feb. 8, 1996. 23 pages.

Profile document. 1 page. First Sentence: "The annual IADC/SPE Drilling Conference was held in Dallas in Febuary." Spring, 2002.

R.S. Plateau Offshore A.S., "Dual Operation Semisubmersible Drilling Rig," Confidential document regarding concept strategy. 6 Pages.

Rundt et al, "Simultaneous Activities Offshore Norway: A Review of Practices and Results," Paper Presented at the 13th Annual Offshore Technology Conference in Houston, TX. May 4-7, 1981. 10 Pages.

Unknown Author, "New Floater Sinks Wells in Pairs," Offshore, May 1988. p. 31.

Unknown Author, "Super Barge Saddles Up for Drilling Duties," Offshore Engineer, Dec. 1994. p. 16-17.

Vigeant, "Deepwater Driven Advancements in Well Control Equipment and Systems," IADC/SPE Drilling Conference. © 1998. Paper prepared for presentation at the 1998 IADC/SPE Drilling Conference held in Dallas, TX., Mar. 3-6, 1988. 11 Pages.

* cited by examiner

DUAL-BOP AND COMMON RISER SYSTEM

CROSS-REFERENCE TO RELATED APPLICATIONS

This application claims the benefit of U.S. Provisional Patent Application 60/753,054 filed 22 Dec. 2005.

TECHNICAL FIELD

The disclosure relates to the field of natural resource exploration and development, specifically the drilling of wells.

BACKGROUND OF THE INVENTION

There is currently a backlog of high pressure subsea hydrocarbon reservoirs identified as suitable for development. Many of these reservoirs currently would require difficult and/or cost-prohibitive processes to be developed. Thus, there is a need for alternative methods for developing these natural resources.

BRIEF SUMMARY OF THE INVENTION

One embodiment of the invention is a method of drilling a well comprising the steps of drilling to a first well depth with a drilling apparatus having a first blowout prevention component, and drilling to a second well depth with a drilling apparatus having a second blowout prevention component.

In another embodiment of the invention, the method further comprises the step of replacing in the drilling apparatus the first blowout prevention component with the second blowout prevention component.

In another embodiment of the invention, the method further comprises the step of placing the first blow out prevention component on a storage location unconnected to the first well depth.

In another embodiment of the invention, the method further comprises the steps of installing the second blowout prevention component onto a first well head, and assembling the drilling apparatus having the second blowout prevention component on the first well head.

In another embodiment of the invention, the step of installing the second blowout prevention component onto the first well head is performed utilizing a lowering apparatus separate from the drilling apparatus.

In another embodiment of the invention, the first blowout prevention component has a lower pressure rating than the second blowout prevention component.

In another embodiment of the invention, the second well depth penetrates into a high pressure reservoir.

In another embodiment of the invention, the first blowout prevention component has a pressure rating of 15,000 psi or less and the second blowout prevention component has a pressure rating of 20,000 psi or greater.

In another embodiment of the invention, the first blowout prevention component has a pressure rating of 5,000, 10,000 or 15,000 psi and the second blowout prevention component has a pressure rating of 10,000, 15,000 or 20,000 psi.

In another embodiment of the invention, at least one blow out prevention component diameter is selected from the group consisting of 11 and ¾ inch, 13 and ⅝ inch, 16 and ¾ inch, 18 and ¾ inch, 21 and ¼ inch and combinations thereof.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Preferred Areas of Use

Figure 1:
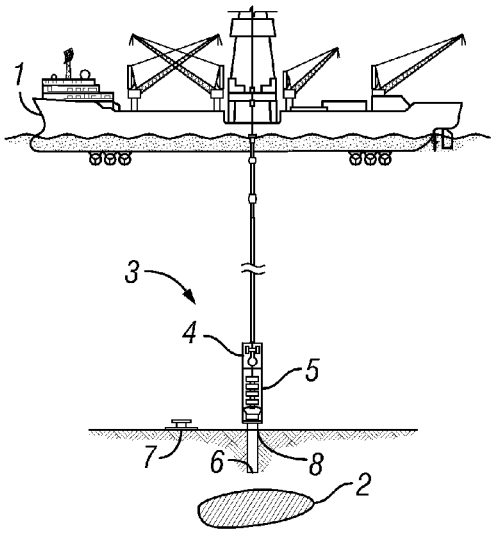
FIG. 1 is a schematic view of a typical offshore drillship operation wherein the drilling apparatus comprises a lower pressure rated first BOP.

The claimed methods are generally intended for use in developing offshore subsea wells for recovery of hydrocarbons, none hydrocarbon gasses, or other natural resources. However, the methods are not necessarily restricted to this context and may encompass any underwater wells such as beneath lakes or aquifers. The claimed methods are generally intended for use in developing high pressure reservoirs of natural resources. A specific context of use for the claimed methods is subsea drilling into high pressure hydrocarbon reservoirs.

Preferred Equipment

Drilling Apparatus: A preferred drilling apparatus includes a Blow Out Prevention Component and other components for drilling a well. For example, a common subsea well drilling procedure involves lowering a Blow Out Prevention Component from a drilling platform to the sea floor by way of a chain of "risers". A riser is commonly 50-90 ft long and generally includes a central larger pipe section with a top and bottom section for connecting the riser to two other risers at each end, thereby forming a vertical chain of risers from the platform to the seabed. Each riser normally includes three or more small pipes extending axially along the riser from end to end and circumferentially spaced around the main central pipe section. Two of these pipes are spaced 180° apart and function as a kill line and choke line for pumping mud, drilling lubricants or other fluids to the Blow Out Prevention Component to control pressure in a well hole. The choke and kill lines, when present, should generally be rated to handle at least the actual fluid pressures experienced during operations and preferably match or exceed the pressure rating of a Blow Out Prevention Component in use. The risers may be any device capable of connecting the platform to the well for drilling activities.

Blow Out Prevention Component (BOP): The BOP generally attaches to a Lower Marine Riser Package (LRMP) by a ball joint or flex joint and a riser adapter. These components make it possible to connect the lowermost riser to the BOP whereby a string of risers are connected to the BOP and form a chain from the drilling platform to the sea bed. This chain of risers with ball joint and/or flex joint may pivot and/or rotate during drilling and production, which is generally required for subsea well drilling and production. The BOP may be any device capable of preventing a well blow out. BOP's generally come with a pressure rating which identifies the pressure ranges of fluids moving out of a well for which the BOP is capable of reliably regulating. Common pressure ratings are 5,000; 10,000; 15,000; and 20,000 psi.

Lowering Apparatus: The lowering apparatus refers to the equipment used to lower the second BOP to the seabed. The lowering apparatus may be a crane or other equipment capable of supporting the weight of the second BOP and lowering it to the seabed. The second BOP 10 can be lowered on a wire or tubular members. Tubular members suitable for such operations include but are not limited to drill pipe or a second riser. One skilled in the art understands, however, that any device capable of lowering a BOP from a platform may be used. The lowering apparatus may be adapted to lower the second BOP 10 over the side or through the moon pool of drilling platform 1.

Well Head: A well head is a surface or seabed termination of a wellbore that generally has the necessary components for attaching a BOP. The well head also incorporates the necessary components for hanging casing and production tubing and installing a "Christmas tree" and flow-control components.

Well Depth: The well depth refers to the length of a wellbore, generally in a substantially vertical trajectory from the platform to a reservoir. However, the wellbore may be in any direction and specific drilling techniques may create slanted, horizontal or even inclined wellbores. The claimed methods are compatible with any such drilling techniques. For example, a first well depth may be from a subsea well head to a substantially vertical point underground. A second well depth may then be extended in an angled trajectory to penetrate a reservoir.

Storage Location: The storage location refers to the location on or near the seabed and/or well hole where the BOP or other equipment are stored. The storage location often includes structure for securing the BOP. For example, in the preferred embodiment the storage location includes a well head. However, One skilled in the art readily understands that other configurations are acceptable. For example, a mud mat can be positioned on the seabed. The storage locations are generally positioned proximate the drilling location. In one embodiment, the storage location in spaced from the drilling location such that it is directly below the apparatus used to lower the second BOP. Additionally, a preferred embodiment includes one storage location. However, multiple storage locations can be used.

The methods disclosed herein are not limited to the foregoing and may be carried out with any functional equipment compatible with the relevant circumstances.

A Preferred Embodiment

Figure 2:
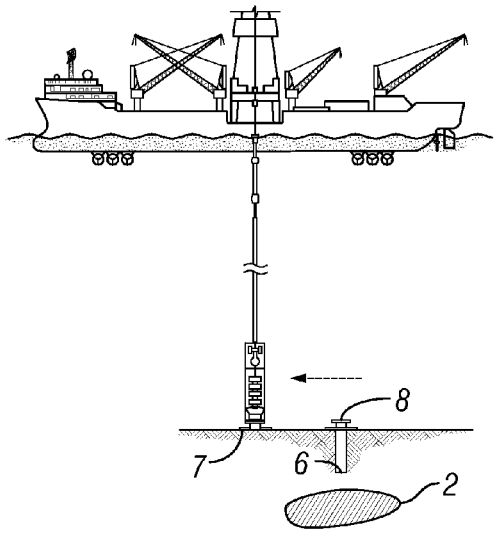
FIG. 2 is a schematic view of a second phase of a preferred embodiment of the claimed methods wherein the drilling apparatus is transferred to a storage location proximate to the primary wellhead.
Figure 3:
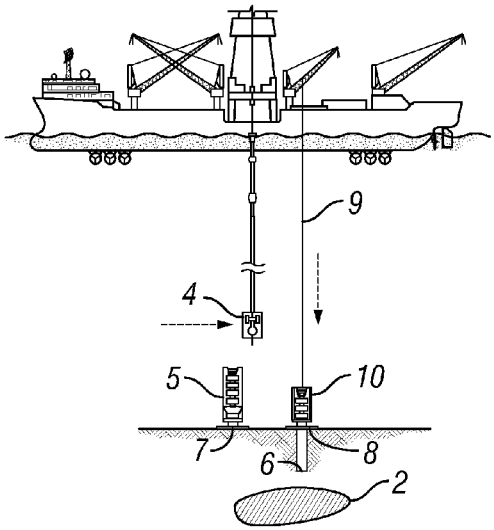
FIG. 3 is a schematic view of a third phase of a preferred embodiment of the claimed methods wherein the drilling apparatus is disassembled and a second BOP placed on the active wellhead.
Figure 4:
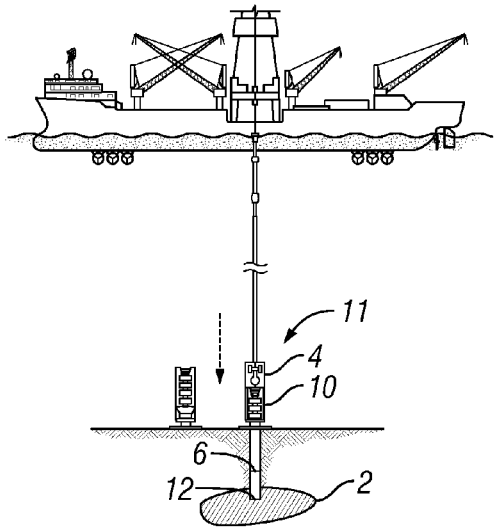
FIG. 4 is a schematic view of a fourth phase of a preferred embodiment of the claimed methods wherein the drilling apparatus is reassembled on the active wellhead to incorporate a second higher pressure rated BOP.

A preferred, exemplary embodiment of the claimed methods is now described with reference to FIGS. 1-4 of the Description. The exemplary embodiment relates to subsea well drilling operations from a floating platform 1 into a high pressure hydrocarbon reservoir 2. In FIG. 1, a wellbore is drilled using a first drilling apparatus 3 which includes a Lower Marine Riser Package (LMRP) 4 operably connected to a first BOP 5 which can be a conventional 18 and ¾ inch subsea BOP with a pressure rating of 10,000 psi. The drilling apparatus 3 is utilized to drill a wellbore to a first well depth 6 which does not penetrate the reservoir 2. In FIG. 2, the drilling apparatus 3 is repositioned to a separate storage location 7 from the drilling wellhead 8. In FIG. 3, the drilling apparatus 3 is disassembled such that the first BOP 5 is disconnected from the LMRP 4 and left secured to storage location 7. Separately, a lowering apparatus such as a crane lowers a second BOP 10 to the seabed. The second BOP 10 is lowered, in this example, on wire 9. The second BOP 10 is smaller and has a pressure rating of 20,000 psi. Once positioned, the drilling apparatus 3 is connected to the second BOP 10. In FIG. 4, the LMRP 4 is operably connected to the second BOP 10 to complete drilling apparatus 11. The LMRP 4 is capable of operably connecting with both the first 5 and second 10 BOP's. This in particular includes any LMRP 4 kill or choke lines being capable of operating under the higher pressures for which the second BOP 10 is rated. Second drilling apparatus 11 is then utilized to drill to a second well depth 12 which penetrates into the high pressure reservoir 2.

Alternative Embodiments

One category of alternative embodiments would utilize first drilling apparatus 3 and second drilling apparatus 11 from separate platforms. In another embodiment, the second BOP 10 can be lowered on tubular members from a second advancing station that is on the same platform. For example, both advancing stations may be within a single derrick, such as is disclosed in U.S. Pat. No. 6,085,851. In this arrangement, one station is used to drill the well and the second station is used to lower the second BOP 10.

In the preferred embodiment, BOP 5 is positioned on wellhead 8 before BOP 10 is run to the seabed. Alternatively, the first and second BOP may be lowered in any order or at the same time. For example, BOP 10 may be lowered and prepositioned at a first storage location before BOP 5 is lowered to wellhead 8. BOP 10 may also be lowered while drilling operations are being conducted through BOP 5. Further, FIGS. 1-4 show one BOP being secured to the seabed at all times. In an alternative embodiment, there may be times in which neither BOPs is connected to the seabed. For example, while BOP 5 is repositioned to storage location 7, high pressure BOP 10 may be in the process of being run to the seabed.

In the preferred embodiment, storage location 7 is a second well head. Alternatively, storage location 7 may be any number of structures that allow for the temporary storage of equipment that is used on and around the well. For example, mud mats positioned directly on the seabed may be used. Alternatively, storage location 7 may be positioned above the seabed. For example, storage location 7 may be attached to the top of a section of conductor that has been driven into the seabed.

The preferred embodiment disclosed one storage position 7. One skilled in the art readily understands that multiple storage locations may be used. Additionally, storage locations may be spaced from well head 8 to in such a way as to allow BOP 10 to be positioned on well head 8 while BOP 5 is on or above storage location 7.

The preferred embodiment discloses running the second BOP 10 directly to well head 8. Alternatively, the second BOP may be run to a second storage position (not shown). In such a case, the second BOP is landed on the second storage location. The second BOP can then be moved to the well head using lowering apparatus 9, drilling apparatus 3, or combinations thereof.

Drilling apparatus 3 may be repositioned in any of a number of ways known to those skilled in the art. For example, drilling apparatus 3 may be repositioned by skidding the drill floor, repositioning the platform, or using a trip saver. In a preferred embodiment, drilling apparatus is repositioned by repositioning the drilling platform using a dynamic positioning system.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of drilling a well comprising the steps of positioning a first drilling apparatus having a riser connected to a first subsea blowout prevention component on the well;

drilling the well to a first well depth with the first drilling apparatus;

moving the first drilling apparatus from the well to a seabed storage location;

positioning said first drilling apparatus on the seabed storage location, and drilling the well to a second well depth with a second drilling apparatus having the riser connected to a second-subsea blowout prevention component positioned at or near the seabed.

2. The method of claim 1, further comprising the step of replacing in the first drilling apparatus the first subsea blowout prevention component with the second subsea blowout prevention component.

3. The methods of claims 2, wherein the seabed storage location is unconnected to the first well depth.

4. The method of claims 2, further comprising the steps of installing the second subsea blowout prevention component onto a first well head, and assembling the second drilling apparatus having the second subsea blowout prevention component on the first well head.

5. The method of claim 4, wherein the step of installing the second subsea blowout prevention component onto the first well head is performed utilizing a lowering apparatus separate from the second drilling apparatus.

6. The method of claim 1, 2 or 3, wherein the first subsea blowout prevention component has a lower pressure rating than the second subsea blowout prevention component.

7. The method of claim 6, wherein the second well depth penetrates into a high pressure reservoir.

8. The method of claim 6, wherein the first subsea blowout prevention component has a pressure rating of 15,000 psi or less and the second subsea blowout prevention component has a pressure rating of 20,000 psi or greater.

9. The method of claim 8, wherein the first subsea blowout prevention component has a pressure rating of 5,000, 10,000 or 15,000 psi and the second subsea blowout prevention component has a pressure rating of 10,000, 15,000 or 20,000 psi.

10. The method of claim 1 wherein at least one subsea blowout prevention component diameter is selected from the group consisting of 11 and ¾ inch, 13 and ⅝ inch, 16 and ¾ inch, 18 and ¾ inch, 21 and ¼ inch and combinations thereof.

11. A method for drilling a well comprising the steps of:

positioning a first subsea blowout preventer on a well head;

drilling a first portion of the well through a riser and lower marine riser package connected to the first subsea blowout preventer;

removing the riser, lower marine riser package, and first subsea blowout preventer from the well head;

positioning the riser, lower marine riser package, and first subsea blowout preventer on a seabed storage location;

separating the lower marine riser package from the first subsea blowout preventer;

lowering a second subsea blowout preventer to the well head; and drilling a second portion of the well through the riser and lower marine riser package connected to the second subsea blowout preventer.

12. The method of claim 11, wherein the first subsea blowout preventer is positioned on the well head using a first lowering apparatus and the second subsea blowout preventer is lowered to the seabed using a second lowering apparatus.

13. The method of claim 12 wherein the first and second lowering apparatuses are supported by a single derrick.

14. The method of claim 12, wherein the first apparatus is supported by a derrick and the second lowering apparatus is a crane.

15. The method of claim 12, wherein at least a portion of the time used for lowering the second subsea blowout preventer to the well head occurs before the first portion of the well has been drilled.

16. The method of claim 11, further comprising the step of positioning the second subsea blowout preventer on a second seabed storage location.

17. The method of claim 11, wherein the step of separating the lower marine riser package from the first subsea blowout preventer occurs after the step of positioning the first subsea blowout preventer on the seabed storage location; and wherein said method further comprises the step of connecting the lower marine riser package to the second subsea blowout preventer.

18. The method of claim 17, wherein the seabed storage location is a selected from the group consisting of a second well head, mud mat, and a section of conductor driven into the seabed.

19. The method of claim 11, further comprising the step of lowering the first subsea blowout preventer to a seabed storage location.

20. The method of claim 19, further comprising the step of disconnecting the lower marine riser package from the second subsea blowout preventer and connecting it to the first subsea blowout preventer.

* * * * *